US009400128B2

(12) United States Patent
Yamaguchi

(10) Patent No.: US 9,400,128 B2
(45) Date of Patent: Jul. 26, 2016

(54) TEMPERATURE CONTROL DEVICE AND TEMPERATURE ELEMENT

(75) Inventor: Shigeo Yamaguchi, Kanagawa (JP)

(73) Assignee: KANAGAWA UNIVERSITY, Kanagawa (JP)

( * ) Notice: Subject to any disclaimer, the term of this patent is extended or adjusted under 35 U.S.C. 154(b) by 302 days.

(21) Appl. No.: 14/126,750

(22) PCT Filed: May 8, 2012

(86) PCT No.: PCT/JP2012/061747

§ 371 (c)(1),
(2), (4) Date: Dec. 16, 2013

(87) PCT Pub. No.: WO2012/172884

PCT Pub. Date: Dec. 20, 2012

(65) Prior Publication Data

US 2014/0130518 A1 May 15, 2014

(30) Foreign Application Priority Data

Jun. 16, 2011 (JP) ..... 2011-134496

(51) Int. Cl.
*F25B 21/02* (2006.01)
*B01L 7/00* (2006.01)

(52) U.S. Cl.
CPC . *F25B 21/02* (2013.01); *B01L 7/52* (2013.01); *B01L 2300/1822* (2013.01)

(58) Field of Classification Search
CPC ..... B01L 2300/1822; F25D 21/02
See application file for complete search history.

(56) References Cited

U.S. PATENT DOCUMENTS 4,865,986 A * 9/1989 Coy ..... F25B 21/02 422/63
6,193,866 B1 * 2/2001 Bader ..... B82Y 30/00 204/450
6,558,947 B1 * 5/2003 Lund ..... B01L 3/50851 219/428
6,657,169 B2 * 12/2003 Brown ..... B01L 7/52 219/385
2010/0101237 A1 * 4/2010 Wu ..... F25B 21/02 62/3.2

FOREIGN PATENT DOCUMENTS

JP 5-317030 A 12/1993
JP 2000-270837 A 10/2000

(Continued)

OTHER PUBLICATIONS

International Search Report for International Application No. PCT/JP2012/061747, mailed Aug. 7, 2012, with English translation.

*Primary Examiner* — Emmanuel Duke
(74) *Attorney, Agent, or Firm* — Cantor Colburn LLP

(57) ABSTRACT

A temperature element may be provided with: a combination of a p type semiconductor and an n type semiconductor disposed separated from each other; a metal well, which has a mounting part on which a container for DNA samples is directly mounted and which is connected to both the p type semiconductor and the n type semiconductor individually; an electrode and heat dissipating plate that is connected to the p type semiconductor and to which a voltage is applied by a temperature control section; and an electrode and heat dissipating plate that is connected to the n type semiconductor and to which a voltage is applied by the temperature control section. The shape of the metal well is formed into substantially the same shape as the outside shape of the container for DNA samples.

13 Claims, 8 Drawing Sheets

(56) References Cited

FOREIGN PATENT DOCUMENTS

| | | | | |
|---|---|---|---|---|
| JP | 2006-223292 | A | | 8/2006 |
| JP | 2006223292 | A | * | 8/2006 |
| JP | 2007-78393 | A | | 3/2007 |
| JP | 2007-198718 | A | | 8/2007 |
| JP | 2011-100939 | A | | 5/2011 |
| JP | 2011-125287 | A | | 6/2011 |
| JP | 2011-188749 | A | | 9/2011 |
| JP | 2012-055293 | A | | 3/2012 |

* cited by examiner

TEMPERATURE CONTROL DEVICE AND TEMPERATURE ELEMENT

CROSS REFERENCE TO RELATED APPLICATIONS

This is the U.S. national stage of application No. PCT/JP2012/061747, filed on 8 May 2012. Priority under 35 U.S.C. §119(a) and 35 U.S.C. §365(b) is claimed from Japanese Application No. 2011-134496, filed 16 Jun. 2011, the disclosure of which is also incorporated herein by reference.

TECHNICAL FIELD

The present invention relates to a temperature control device and a temperature element applicable to a method of controlling the temperature of a liquid, such as that used in a PCR method for amplifying a DNA sample; and in particular, the present invention relates to a temperature control device and a temperature element capable of realizing highly responsive temperature control of a liquid such as a DNA sample in PCR.

BACKGROUND ART

PCR (polymerase chain reaction) is generally known as a technique of amplifying DNA (deoxyribonucleic acid). PCR is a technique of amplifying DNA by subjecting a DNA sample to repetitive treatment of heating or cooling a reaction solution including primer, enzyme, and deoxyribonucleoside triphosphate to be reacted with the DNA sample in accordance with a predetermined pattern of temporal transition of a temperature target value.

An element (hereinafter referred to as "Peltier element") producing the Peltier effect is utilized for heating or cooling a DNA sample (reaction solution) in a conventional DNA amplification device for amplifying DNA through PCR as described above (see Patent Document 1 or 2). The Peltier effect refers to a phenomenon of thermal absorption, which occurs in a joining region between different electric conductors (e.g. a p-type semiconductor and an n-type semiconductor) when an electric current is applied to the joining region.

FIG. 1 is a cross-sectional view showing a schematic configuration of a conventional Peltier element 1.

The conventional Peltier element 1 is configured by laminating a radiator plate 21B; electrode plates 23P and 23N to which voltage is applied; a set of p-type semiconductor 24P and n-type semiconductor 24N respectively joined to the electrode plate 23P and the electrode plate 23N; an electrode plate 22A joined to the set; and a radiator plate 21A, in an ascending order from a lower portion of FIG. 1.

What is referred to as a Peltier element in Patent Document 2 is composed of metal plates a11 and a12 respectively corresponding to the electrode plates 23P and 23N; a set of p-type semiconductor a4 and n-type semiconductor a3 respectively corresponding to the set of p-type semiconductor 24P and n-type semiconductor 24N; and a metal plate a2 corresponding to the electrode plate 22A (see FIG. 6 of Patent Document 2). However, a temperature control target to be heated or cooled by the Peltier element as used in Patent Document 2 is arranged with intervention of a thermally conductive plate 12, 22 or the like (see FIG. 1 of Patent Document 2). That is to say, in FIG. 1, the temperature control target is a container 31, and the radiator plate 21A intervening between the container 31 and the electrode plate 22A in FIG. 1 is equivalent to the thermally conductive plate 12, 22 or the like intervening between the temperature control target (corresponding to the container 3) and the metal plate a2 in Patent Document 2. In other words, the thermally conductive plate 12, 22 or the like in Patent Document 2 corresponds to the radiator plate 21A of FIG. 1. Similarly, a lower face of radiator fins 51 and 52 in Patent Document 2 corresponds to the radiator plate 21B of FIG. 1. In conclusion, Patent Document 2 merely discloses that temperature of a temperature control target is controlled by using the conventional Peltier element 1 of FIG. 1 without any modification.

For simplicity of description, the regions of the upper side of the conventional Peltier element 1 in FIG. 1, namely the radiator plate 21A and the electrode plate 22A, are hereinafter collectively referred to as "side-A region". On the other hand, the regions of the lower side of the conventional Peltier element 1 in FIG. 1, namely the radiator plate 21B and the electrode plates 23P and 23N, are hereinafter collectively referred to as "side-B region". Applying voltage such that the electrode plate 23N is at high electric potential and the electrode plate 23P is at low electric potential on the basis of the electrode plate 23N is hereinafter described as "applying positive voltage to the conventional Pettier element 1". Conversely, applying voltage such that the electrode plate 23N is at low electric potential and the electrode plate 23P is at high electric potential is hereinafter described as "applying negative voltage to the conventional Pettier element 1".

For example, as shown in FIG. 1, it is assumed that the container 31 containing a DNA sample (reaction solution) is arranged on the side-A region of the conventional Peltier element 1, more specifically, on a surface of the radiator plate 21A.

In this case, when positive voltage is applied to the conventional Peltier element 1, an electric current flows from the electrode plate 23N toward the electrode plate 23P. More specifically, the electric current flows in the order of arrangement from the electrode plate 23N to the n-type semiconductor 24N, the electrode plate 22A, the p-type semiconductor 24P, and the electrode plate 23P. As a result, the side-A region serves as a heat sink, and the side-B region serves as a heat generator. More specifically, the positive voltage applied to the conventional Peltier element 1 produces temperature difference $\Delta T$, such that the temperature of the side-A region is low and the temperature of the side-B region is high, in accordance with a value of the electric current flowing from the electrode plate 23N toward the electrode plate 23P. As a result, the heat of the container 31 is absorbed by the side-A region, and the container 31 is cooled.

In contrast, when negative voltage is applied to the conventional Peltier element 1, an electric current flows in a direction opposite to the direction in the case of applying positive voltage. More specifically, the electric current flows in the order of arrangement from the electrode plate 23P to the p-type semiconductor 24P, the electrode plate 22A, the n-type semiconductor 24N, and the electrode plate 23N. As a result, conversely to the case of applying positive voltage, the side-A region serves as a heat generator, and the side-B region serves as a heat sink. More specifically, the negative voltage applied to the conventional Peltier element 1 produces temperature difference $\Delta T$, such that the temperature of the side-A region is high and the temperature of the side-B region is low, in accordance with a value of the electric current flowing from the electrode plate 23P toward the electrode plate 23N. As a result, the heat emitted from the side-A region is transferred to the container 31, thereby heating the container 31.

Therefore, temperature control of a DNA sample in PCR can be realized by way of variable control of a value of an electric current flowing between the electrode plate 23N and the electrode plate 23P so as to follow a predetermined pattern of temporal transition of a temperature target value.

Patent Document 1: Japanese Unexamined Patent Application, Publication No. 2006-223292

Patent Document 2: Japanese Unexamined Patent Application, Publication No. 2007-198718

DISCLOSURE OF THE INVENTION

Problems to be Solved by the Invention

However, in a case of utilizing the conventional DNA amplification device as disclosed in Patent Documents 1 and 2, temperature of a DNA sample (reaction solution) cannot sufficiently transition so as to follow a predetermined pattern of temporal transition of a temperature target value. That is to say, the conventional DNA amplification device as disclosed in Patent Documents 1 and 2 cannot achieve sufficient responsiveness in controlling temperature of a DNA sample (reaction solution) in PCR.

The same applies to conventional temperature control of other liquids, in a sense that sufficient responsiveness cannot be achieved as described above.

The present invention has been made in view of such situations, and an object of the present invention is to realize highly responsive temperature control of a liquid such as a DNA sample in a method such as PCR for controlling temperature of a liquid.

In the present specification, the term "high responsiveness" is used to mean that response speed is high.

Means for Solving the Problems

The temperature control device (for example, a DNA amplification device 51 in the embodiments) of the present invention is characterized in that the temperature control device for heating or cooling an object (for example, a plastic tube 91 in the embodiments) includes: a temperature element (for example, a temperature element 61 in the embodiments) for heating or cooling the object by way of the Peltier effect; and a control unit (for example, a temperature control unit 62 in the embodiments) for executing energization control of the temperature element; in which the temperature element includes: a set of a p-type semiconductor (for example, a p-type semiconductor 72P in the embodiments) and an n-type semiconductor (for example, an n-type semiconductor 72N in the embodiments) arranged to be separated from each other; a joining region (for example, a metal well 71 in the embodiments) having a mounting portion (for example, a mounting portion 81 in the embodiments) for mounting the object, joining with the p-type semiconductor on a first or second surface, and joining with the n-type semiconductor on another second or first surface opposed to the first or second surface; a first electrode region (for example, an electrode-radiator plate 73P in the embodiments) joined to the p-type semiconductor, to which the control unit applies voltage; and a second electrode region (for example, an electrode-radiator plate 73N in the embodiments) joined to the n-type semiconductor, to which the control unit applies voltage; in which the joining region is formed into a shape substantially identical to an external shape of the object; and in a case in which the control unit applies different voltage to the first electrode region and the second electrode region to produce potential difference between the p-type semiconductor and the n-type semiconductor, the joining region produces the Peltier effect by applying an electric current and transferring heat from one to the other of the p-type semiconductor and the n-type semiconductor.

According to the present invention, an object is joined to the p-type semiconductor and the N-type semiconductor in an intimate manner through the joining region provided to the temperature element, thereby providing a function of producing the Peltier effect by applying an electric current and transferring heat from one to the other of the p-type semiconductor and the n-type semiconductor. The joining region includes the mounting portion; and a predetermined container containing a DNA sample can be directly mounted on the mounting portion. Therefore, the DNA sample is directly heated or cooled by the p-type semiconductor and the n-type semiconductor without intervention of a delay element (for example, extra thickness of the joining region) for the temperature control system. As a result, highly responsive temperature control is realized, as compared to the case of employing the conventional joining region.

In this case, the object is a predetermined container used for containing DNA (deoxyribonucleic acid), and the container is mounted on the mounting portion.

By applying the present invention to PCR, the temperature of the DNA sample can transition so as to follow a predetermined pattern of the temporal transition of the temperature target value. That is to say, highly responsive temperature control of a DNA sample can be realized in PCR.

In this case, a cooling unit (for example, a water-cooling unit 63 in the embodiments) for cooling at least one of the first electrode region and the second electrode region of the temperature element may be further provided.

Furthermore, in this case, the temperature control device may be a portable device. A portable device refers to a device that is configured such that a person can freely carry the device.

The temperature element of the present invention (for example, a temperature element 61 in the embodiments) is characterized in that the temperature element for heating or cooling an object (for example, a plastic tube 82 in the embodiments) by way of the Peltier effect includes: a set of a p-type semiconductor (for example, a p-type semiconductor 72P in the embodiments) and an n-type semiconductor (for example, an n-type semiconductor 72N in the embodiments) arranged to be separated from each other; a joining region (for example, a metal well 71 in the embodiments) having a mounting portion (for example, a mounting portion 81 in the embodiments) for mounting the object, and joining each of the p-type semiconductor and the n-type semiconductor; a first electrode region (for example, an electrode-radiator plate 73P in the embodiments) joined to the p-type semiconductor, to which voltage is externally applied; and a second electrode region (for example, an electrode-radiator plate 73N in the embodiments) joined to the n-type semiconductor, to which voltage is externally applied; in which the joining region is formed into a shape substantially identical to an external shape of the object, and in a case in which different voltage is externally applied to the first electrode region and the second electrode region to produce potential difference between the p-type semiconductor and the n-type semiconductor, the joining region produces the Peltier effect by applying an electric current and transferring heat from one to the other of the p-type semiconductor and the n-type semiconductor.

According to the present invention, the object is joined to the p-type semiconductor and the N-type semiconductor in an intimate manner through the joining region provided to the temperature element, thereby providing a function of producing the Peltier effect by applying an electric current and transferring heat from one to the other of the p-type semiconductor and the n-type semiconductor. The joining region includes the mounting portion, and a predetermined container containing a DNA sample can be directly mounted on the mounting portion. Therefore, the DNA sample is directly heated or cooled by the p-type semiconductor and the n-type semiconductor without intervention of a delay element (for example, extra thickness of the joining region) for the temperature control system. As a result, highly responsive temperature control is realized, as compared to the case of employing the conventional joining region. Therefore, by applying the temperature element according to the present invention, namely, by employing a predetermined container capable of containing a DNA sample as the object, the temperature of the DNA sample can transition so as to follow a predetermined pattern of temporal transition of a temperature target value in PCR. That is to say, highly responsive temperature control of a DNA sample can be realized in PCR.

In this case, the mounting portion can be processed in conformity to a shape of the object, and can be formed in the joining region.

The joining region can be formed substantially uniformly in thickness dimension, and can be formed along a shape of the mounting portion.

The temperature control device (for example, a DNA amplification device 151 or 251 in the embodiments) of the present invention is characterized in that the temperature control device for heating or cooling an object (for example, a liquid including a DNA sample in the embodiments) includes: a temperature element (for example, a temperature element 61 in the embodiments) for heating or cooling the object by way of the Peltier effect; and a control unit (for example, a temperature control unit 62 in the embodiments) for executing energization control of the temperature element; in which the temperature element includes: a set of a p-type semiconductor (for example, a p-type semiconductor 72P in the embodiments) and an n-type semiconductor (for example, an n-type semiconductor 72N in the embodiments) arranged to be separated from each other; a joining region (for example, a metal well 71 in the embodiments) having a placing portion (for example, a placing portion 111 in the embodiments) for placing the object, joining with the p-type semiconductor on a first or second region, and joining with the n-type semiconductor on another second or first region opposed to the first or second region; a first electrode region (for example, an electrode-radiator plate 73P in the embodiments) joined to the p-type semiconductor, to which the control unit applies voltage; and a second electrode region (for example, an electrode-radiator plate 73N in the embodiments) joined to the n-type semiconductor, to which the control unit applies voltage; in which the joining region is formed into a shape substantially identical to an external shape of the placing portion; and in a case in which the control unit applies different voltage to the first electrode region and the second electrode region to produce potential difference between the p-type semiconductor and the n-type semiconductor, the joining region produces the Peltier effect by applying an electric current and transferring heat from one to the other of the p-type semiconductor and the n-type semiconductor.

According to the present invention, an object is joined to the p-type semiconductor and the N-type semiconductor in an intimate manner through the joining region provided to the temperature element, thereby providing a function of producing the Peltier effect by applying an electric current and transferring heat from one to the other of the p-type semiconductor and the n-type semiconductor. The joining region includes the placing portion, and a liquid including a DNA sample can be directly placed on the placing portion. Therefore, the DNA sample is directly heated or cooled by the p-type semiconductor and the n-type semiconductor without intervention of a delay element (for example, extra thickness of the joining region) for the temperature control system. As a result, highly responsive temperature control is realized, as compared to the case of employing the conventional joining region.

In this case, the placing portion is formed to include: an inlet, into which the object is injected (an inlet 121 in the embodiments); and a capillary (a capillary 122 in the embodiments) for causing the object injected from the inlet to travel by way of a capillary phenomenon.

In this case, the placing portion is formed to include a plurality of concave portions (concave portions 221 in the embodiments) for receiving the object.

Effects of the Invention

According to the invention, it is possible to realize highly responsive temperature control of a liquid such as a DNA sample, in a method such as PCR for controlling temperature of a liquid.

EXPLANATION OF REFERENCE NUMERALS

Figure 1:
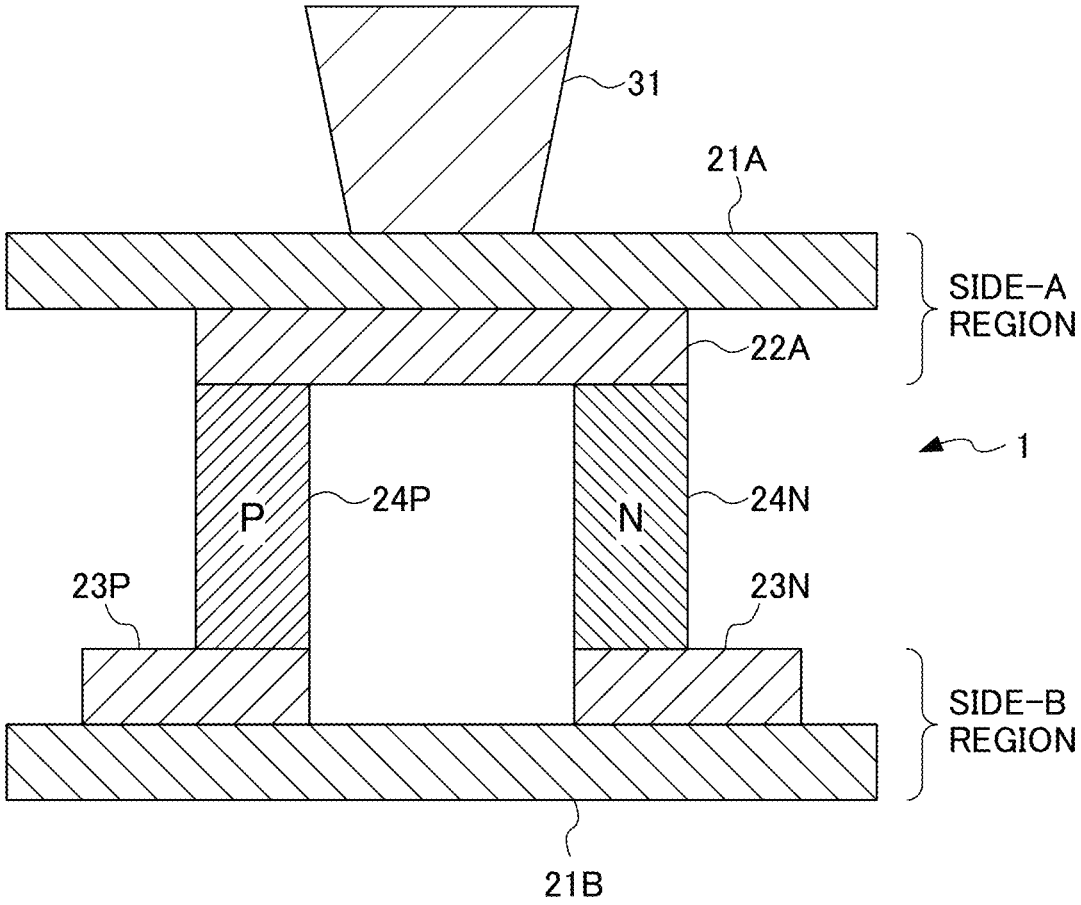
FIG. 1 is a cross-sectional view showing a schematic configuration of a conventional Peltier element.

51 DNA amplification device
61, 61*a*, 61*b* temperature element
62 temperature control unit
63 water-cooling unit
71 metal well
72P p-type semiconductor
72N n-type semiconductor
73P, 73N electrode-radiator plate
74P, 74N water pipe
81 mounting portion
111 placing portion
121 inlet
122 capillary
151 DNA amplification device
171 metal well
211 placing portion
221 concave portion
251 DNA amplification device
271 metal well

PREFERRED MODE FOR CARRYING OUT THE INVENTION

Embodiments of the present invention are hereinafter described with reference to the drawings.

First Embodiment

Figure 2:
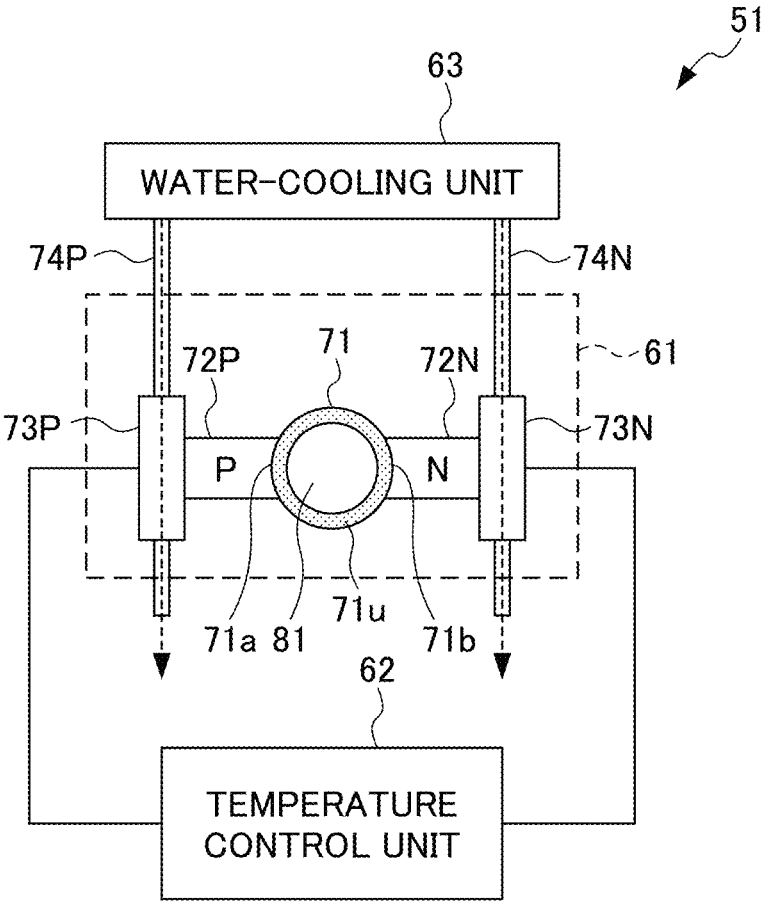
FIG. 2 is a top plan view showing a schematic configuration of a DNA amplification device according to a first embodiment of the present invention.

FIG. 2 is a top plan view showing a schematic configuration of a DNA amplification device 51 according to a first embodiment of the present invention.

The DNA amplification device 51 includes a temperature element 61, a temperature control unit 62, and a water-cooling unit 63. In order to cool or heat an object by the Peltier effect, the temperature element 61 includes a metal well 71, a set of p-type semiconductor 72P and n-type semiconductor 72N, electrode-radiator plates 73P and 73N, and water pipes 74P and 74N.

As shown in FIG. 2, the water pipe 74P is connected to the electrode-radiator plate 73P, and the water pipe 74N is connected to the electrode-radiator plate 73N, respectively. The water-cooling unit 63 runs water through each of the water pipes 74P and 74N, thereby cooling each of the electrode-radiator plates 73P and 73N so as to be maintained at constant temperature. That is to say, the electrode-radiator plates 73P and 73N have a function (hereinafter referred to as a "radiator plate function") similar to that of the radiator plate 21B of the conventional Peltier element 1 of FIG. 1.

Furthermore, the temperature control unit 62 is electrically connected to, and applies voltage to, each of the electrode-radiator plates 73P and 73N. That is to say, the electrode-radiator plate 73P has a function similar to that of the electrode plate 23P of the conventional Peltier element 1 of FIG. 1, and the electrode-radiator plate 73N has a function similar to that of the electrode plate 23N of the conventional Peltier element 1 of FIG. 1. The function is hereinafter referred to as a "voltage-applied function". Although detailed descriptions are provided later, temperature control using the temperature element 61 is implemented by the temperature control unit 62 that controls polarity of voltage (polarity of an electric current) and a value of an electric current, which are applied to the electrode-radiator plates 73P and 73N.

Material, structure, etc. of the electrode-radiator plates 73P and 73N may be arbitrarily selected, as long as the radiator plate function and the voltage-applied function are provided. However, in order to exert the radiator plate function and the voltage-applied function more significantly, it is preferable for the material of the electrode-radiator plates 73P and 73N to have high heat conductivity and low electric resistance. In the present embodiment, copper (Cu) is employed as such material.

One end of the p-type semiconductor 72P is joined to the electrode-radiator plate 73P; whereas one end of the n-type semiconductor 72N is joined to the electrode-radiator plate 73N. That is to say, the p-type semiconductor 72P has a function similar to that of the p-type semiconductor 24P of the conventional Peltier element 1 of FIG. 1, and the N-type semiconductor 72N has a function similar to that of the n-type semiconductor 24N of the conventional Peltier element 1 of FIG. 1.

Material, structure, etc. of the set of the p-type semiconductor 72P and the n-type semiconductor 72N may be arbitrarily selected, as long as the Peltier effect is achieved. However, in the present embodiment, bismuth tellurium, which achieves the Peltier effect more significantly, is employed as the material of the set of the p-type semiconductor 72P and the n-type semiconductor 72N.

The other end of the p-type semiconductor 72P is directly joined to a lateral face 71*a* of the metal well 71; whereas the other end of the n-type semiconductor 72N is directly joined to a lateral face 71*b* opposed to the lateral face 71*a* of the metal well 71.

In this regard, the term "directly joining" or "directly mounting" in the present specification means joining or mounting without intervention of a delay element (e.g. the radiator plate 21A of the conventional Peltier element 1 of FIG. 1) for the temperature control system. Therefore, material for the purpose of joining may naturally intervene between the metal well 71 and the set of the p-type semiconductor 72P and the n-type semiconductor 72N. More specifically, for example, in the present embodiment, the surface of the set of the p-type semiconductor 72P and the n-type semiconductor 72N is plated with nickel, and is further joined to the metal well 71 by way of a low-melting-point alloy such as GaIn. That is to say, in the present embodiment, nickel for the plating and the low-melting-point alloy are employed as the material for the purpose of joining. The joining technique of the present embodiment is merely exemplification, and for example, other various joining techniques can be employed, such as a joining technique by plating with metal other than nickel, a joining technique by double plating, a joining technique by employing other material as the low-melting-point alloy, and a joining technique by soldering in place of the low-melting-point alloy.

In other words, the metal well 71 has a function of directly joining the set of the p-type semiconductor 72P and the n-type semiconductor 72N, namely, the function similar to the electrode plate 22A of the conventional Peltier element 1 of FIG. 1. That is to say, the function produces the Peltier effect by applying an electric current and transferring heat from one to the other of the p-type semiconductor 72P and the n-type semiconductor 72N. The effect is hereinafter referred to as a "bridge-electrode function".

Material of the metal well 71 may be arbitrarily selected, as long as the bridge-electrode function is provided. However, in order to exert the bridge-electrode function more significantly, it is preferable for material with low electric resistance to be employed for the metal well 71; and for example, it is preferable for copper (Cu) or aluminum (Al) to be employed. Aluminum as used herein includes not only pure aluminum but also an aluminum alloy. In the present embodiment, a predetermined aluminum alloy is employed.

A top surface 71*u* of the metal well 71 includes a mounting portion 81 for directly mounting an object to be heated or cooled.

A point notable herein is that an external shape of the metal well 71 is substantially similar to an internal shape of the metal well 71. That is to say, the metal well 71 is thinly formed so as to further reduce the distance between a plastic tube 91 (more precisely, a DNA sample) and the p-type semiconductor 72P and the n-type semiconductor 72N.

Figure 3A:
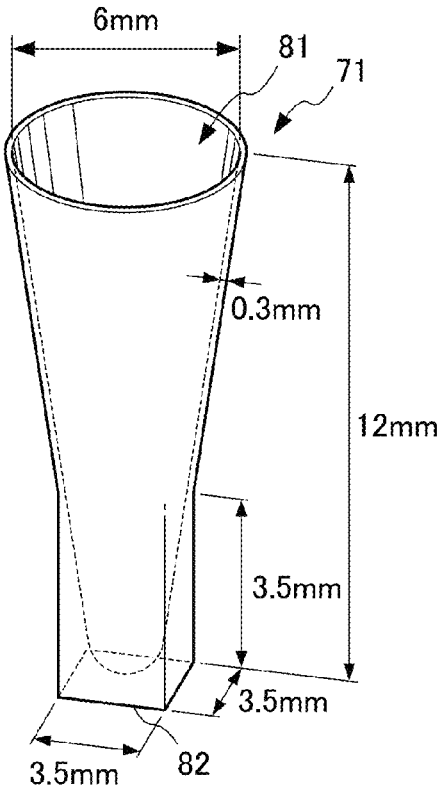
FIGS. 3A and 3B are a perspective view showing a schematic configuration of a metal well of a temperature element of the DNA amplification device of FIG. 2.
Figure 3B:
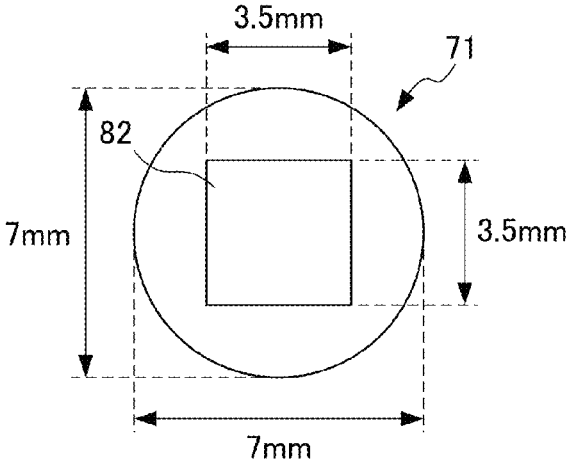
Figure 4:
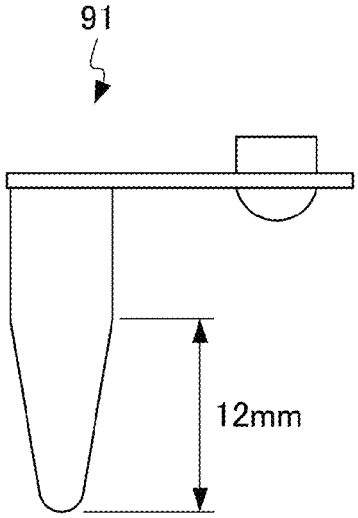
FIG. 4 is a side view showing a schematic configuration of a plastic tube that is an example of an object to be directly mounted on a mounting portion.
Figure 5:
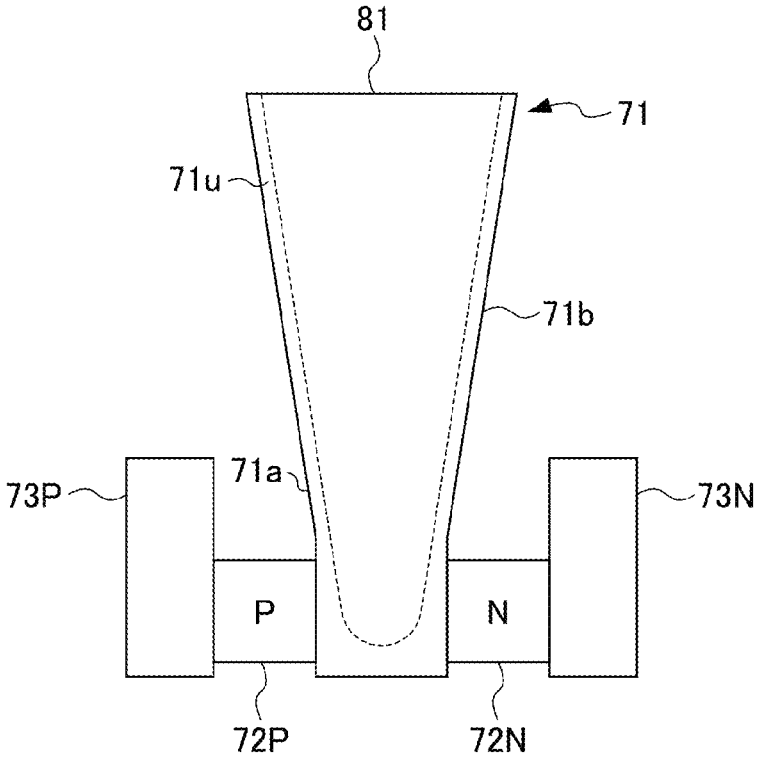
FIG. 5 is a perspective view showing a schematic configuration of the metal well of the temperature element of the DNA amplification device of FIG. 2.

FIGS. 3 to 5 are diagrams showing a schematic configuration of the metal well 71 having the mounting portion 81 as described above. More specifically, FIG. 3A is a perspective view showing the schematic configuration of the metal well 71 having the mounting portion 81 that can directly mount the plastic tube 91 (an example of the object). FIG. 3B is a bottom view showing the metal well 71 viewed from below. Various dimensions (denoted with mm) shown in FIGS. 3A and 3B are dimensions employed in the present embodiment, and are merely exemplification. FIG. 4 is a side view showing a schematic configuration of the plastic tube 91 that is an example of the object directly mounted on the mounting portion 81.

In the present embodiment, the temperature element 61 is provided to the DNA amplification device 51; therefore, more precisely, the object to be heated or cooled by the temperature element 61 is a DNA sample (reaction solution). However, it is difficult to directly heat or cool the DNA sample (reaction solution), which is therefore heated or cooled as contained in the plastic tube 91 as shown in FIG. 4. Accordingly, it is assumed hereinafter that the object to be heated or cooled is the plastic tube 91 for containing the DNA sample (reaction solution).

As shown in FIG. 3A, the mounting portion 81 of the metal well 71 is formed as a concave portion conforming to the shape of the lower side portion of the plastic tube 91 (a portion denoted with a dimension of 12 mm in FIG. 4). In other words, the mounting portion 81 is processed for mounting the plastic tube 91. The thickness dimension of the concave portion provided to the mounting portion 81 is formed to be thin and uniform along the external shape of the plastic tube 91, such that heat thereof can be easily interchanged with the p-type semiconductor 72P and the n-type semiconductor 72N. The thickness can be as thin as possible within a range of strength that can maintain the shape of the metal well 71 depending on the material.

In this manner, in the present embodiment, the plastic tube 91 for containing the DNA sample (reaction solution) is directly mounted to the mounting portion 81. If the conventional Peltier element 1 of FIG. 1 is taken as an analogy, this is equivalent to the container 31 being directly mounted to the inside of the electrode plate 22A without intervention of the radiator plate 21A, by considering that the container 31 corresponds to the plastic tube 91, and that the electrode plate 22A has the bridge-electrode function.

That is to say, in a case in which the container 31 is heated or cooled by using the conventional Peltier element 1 of FIG. 1, the container 31 interchanges heat with the electrode plate 22A having the bridge-electrode function with intervention of the radiator plate 21A. Therefore, the radiator plate 21A formed with ceramic or the like serves as a delay element in the temperature control system for heating or cooling the container 31 by using the conventional Peltier element 1. The delay element amounts to deterioration of the responsiveness of the temperature control using the conventional Peltier element 1 of FIG. 1. Furthermore, as shown in FIG. 5, the plastic tube 91 interchanges heat with the p-type semiconductor 72P and the n-type semiconductor 72N with intervention of the metal well 71. Therefore, a thick metal well 71 serves as a delay element. The delay element amounts to deterioration of the responsiveness of the temperature control.

In contrast, with the temperature control system of the present embodiment, namely with the temperature control system for heating or cooling the plastic tube 91 by using the temperature element 61, the plastic tube 91 can directly interchange heat with the metal well 71 having the bridge-electrode function without intervention of any delay element such as the conventional radiator plate 21A. Therefore, the absence of a delay element amounts to more highly responsive temperature control of the present embodiment, as compared to the case of using the conventional Peltier element 1 of FIG. 1. Furthermore, the metal well 71 of the present embodiment is significantly thin; therefore, the plastic tube 91 does not require extra heat for heating or absorbing heat from the metal well 71 per se; and the p-type semiconductor 72P and the n-type semiconductor 72N can directly interchange heat with the metal well 71. Therefore, the responsiveness of the temperature control system of the present embodiment is higher than that of a case of using an unnecessarily thick metal well 71 (not illustrated). These effects are described later in detail with reference to FIGS. 6 to 9A and 9B.

Next, operations of the DNA amplification device 51 are described.

As described above, from a functional viewpoint, the electrode-radiator plates 73P and 73N of the present embodiment have the radiator plate function and the voltage-applied function, and therefore correspond to the radiator plate 21B and the electrode plates 23P and 23N of the conventional Peltier element 1 of FIG. 1. Therefore, the electrode-radiator plates 73P and 73N behave in the same way as the side-B region of the conventional Peltier element 1. Accordingly, the electrode-radiator plates 73P and 73N are hereinafter referred as "side-B region" in the temperature element 61 of the present embodiment as appropriate.

On the other hand, from a functional viewpoint, the metal well 71 has the bridge-electrode function, and therefore corresponds to the electrode plate 22A of the conventional Peltier element 1 of FIG. 1 as described above. Therefore, the metal well 71 behaves in the same way as the side-A region of the conventional Peltier element 1. Accordingly, the metal well 71 is hereinafter referred as "side-A region" in the temperature element 61 of the present embodiment as appropriate. In this regard, it should be noted that a delay element for the temperature control system, such as the radiator plate 21A of the side-A region in the conventional Peltier element 1, does not exist in the side-A region in the temperature element 61 of the present embodiment.

In the present embodiment, applying voltage by the temperature control unit 62 such that the electrode-radiator plate 73N is at high electric potential and the electrode-radiator plate 73P is at low electric potential on the basis of the electrode-radiator plate 73N as reference is hereinafter described as "applying positive voltage to the temperature element 61". Conversely, applying voltage by the temperature control unit 62 such that the electrode-radiator plate 73N is at low electric potential and the electrode-radiator plate 73P is at high electric potential is hereinafter described as "applying negative voltage to the temperature element 61".

In this case, when the temperature control unit 62 applies positive voltage to the temperature element 61, an electric current flows from the right to left in FIG. 2. More specifically, the electric current flows in the order of arrangement from the electrode-radiator plate 73N to the n-type semiconductor 72N, the metal well 71, the p-type semiconductor 72P, and the electrode-radiator plate 73P. As a result, the metal well 71 being the side-A region serves as a heat sink. That is to say, when heat is emitted from the plastic tube 91 (FIGS. 3A and 3B) directly mounted to the metal well 71 being the side-A region, the heat is directly absorbed by the metal well 71, thereby cooling the plastic tube 91.

More specifically, in accordance with a value (absolute value) of the electric current flowing as a result of applying positive voltage to the temperature element 61, temperature difference ΔT is produced such that the metal well 71 being the side-A region is at low temperature and the electrode-radiator plates 73P and 73N being the side-B region are at high temperature.

In this regard, the low temperature of the side-A region does not mean low temperature in an absolute sense, but means low temperature relative to the temperature of the side-B region. That is to say, as described above, the water-cooling unit 63 water-cools the electrode-radiator plates 73P and 73N being the side-B region so as to be maintained at constant temperature. The constant temperature of the electrode-radiator plates 73P and 73N being the side-B region is hereinafter referred to as "reference temperature". Therefore, the metal well 71 being the side-A region is cooled to the temperature that is lower than the reference temperature by the temperature difference ΔT.

The temperature difference ΔT has a certain limit, but increases with the increase of the value (absolute value) of the electric current flowing as a result of applying positive voltage to the temperature element 61. Therefore, by gradually increasing the value (absolute value) of the electric current, the temperature control unit 62 can gradually increase the temperature difference ΔT, i.e. can gradually decrease the temperature of the metal well 71 being the side-A region. In this case, since the plastic tube 91 is directly cooled by the metal well 71, the responsiveness of the temperature control is high in comparison with a case of cooling through a delay element such as the conventional radiator plate 21A of FIG. 1. Furthermore, since the metal well 71 for cooling the plastic tube 91 is extremely thin, extra cooling of the metal well 71 is not necessary. Therefore, the responsiveness of the temperature control is high in comparison with a case of cooling through a delay element such as a thick metal well 71 (not shown) that requires extra thermal conduction. That is to say, in the present embodiment, since the temperature control unit 62 provides a target value for temperature control as an electric current value, the followability of decreasing the temperature of an object (the plastic tube 91) to the target value of the temperature control is high.

In a case in which the temperature control unit 62 reverses the polarity of the output voltage thereafter, namely, in a case in which negative voltage is applied to the temperature element 61, an electric current flows from the left to right in FIG. 2, in a direction reverse to the case of applying positive voltage thereto. More specifically, the electric current flows in the order of arrangement from the electrode-radiator plate 73P to the p-type semiconductor 72P, the metal well 71, the n-type semiconductor 72N, and the electrode-radiator plate 73N. As a result, the metal well 71 being the side-A region serves as a heat generator in turn. That is to say, when heat is emitted from the metal well 71 being the side-A region, the heat is directly transferred to the plastic tube 91, thereby heating the plastic tube 91.

More specifically, when negative voltage is applied to the temperature element 61, the metal well 71 being the side-A region is heated to the temperature that is higher than the reference temperature by the temperature difference ΔT. The temperature difference ΔT has a certain limit, but increases as the increase of the value (absolute value) of the electric current flowing as a result of applying negative voltage to the temperature element 61. Therefore, by gradually increasing the value (absolute value) of the electric current, the temperature control unit 62 can gradually increase the temperature difference ΔT, i.e. can gradually increase the temperature of the metal well 71 being the side-A region. In this case, since the plastic tube 91 is directly heated by the metal well 71, the responsiveness of the temperature control is high in comparison with a case of heating through a delay element such as the conventional radiator plate 21A of FIG. 1. Furthermore, since the metal well 71 for heating the plastic tube 91 is extremely thin, extra heating of the metal well 71 is not necessary. Therefore, the responsiveness of the temperature control is high in comparison with a case of heating through a delay element such as the thick metal well 71 (not shown) that requires extra thermal conduction. That is to say, since the temperature control unit 62 provides a target value for temperature control as an electric current value, the followability of increasing the temperature of an object (the plastic tube 91) to the target value of the temperature control is high.

In this manner, by changing the polarity of the output voltage (current polarity) and the electric current value, the temperature control unit 62 can control the temperature of the plastic tube 91 by using the temperature element 61. Therefore, PCR can be easily implemented by providing the temperature control unit 62 with a predetermined pattern of temporal transition of an output current as a predetermined pattern of temporal transition of a target value of temperature. That is to say, a DNA sample (reaction solution) stored in the plastic tube 91 is heated or cooled in a thermal cycle of the temperature element 61 varying in accordance with the predetermined pattern, and as a result, the DNA is amplified.

The present invention is not limited to the present embodiment, and modification, improvement and the like within a scope that can achieve the object of the invention are included in the present invention.

For example, regarding the number of the set of p-type semiconductor and n-type semiconductor, the embodiment of FIG. 2 describes only one set of the p-type semiconductor 72P and the n-type semiconductor 72*n*; however, the number is not limited thereto, and a plurality of sets are allowed.

Some embodiments have been described above as the embodiments of the present invention from the viewpoint of the set of p-type semiconductor and n-type semiconductor. Naturally, the present invention can take various embodiments from other viewpoints.

For example, regarding the technique of cooling the electrode-radiator plate for the purpose of maintaining the reference temperature of the temperature element 61, the water-cooling technique using the water-cooling unit 63 is employed in the embodiment of FIG. 2; however, the technique is not limited thereto, and for example, other techniques such as a cooling technique using a liquid other than water or an air-cooling technique may be employed.

For example, in the embodiment of FIG. 2, the object to be cooled or heated by the temperature element 61 is the plastic tube 91, more precisely, the DNA sample (reaction solution) stored therein; however, the object is not limited in particular, so long as the object can be directly mounted on the mounting portion 81 of the metal well 71. In other words, the shape and number of the mounting portion 81 of the metal well 71 are not limited to the example of FIGS. 3A and 3B in particular, and can be arbitrarily changed depending on an object to be cooled or heated. However, in this case, it is preferable for the mounting portion 81 to be processed in conformity to the shape of the object so as to be formed within the metal well 71, which further remarkably enhances the responsiveness of heating or cooling the object.

For example, for the purpose of heating or cooling a plurality of plastic tubes 91, a plurality of metal wells 71 may be connected thereto, or a plurality of mounting portions 81 may be formed in the metal well 71. That is to say, the number of the temperature element 61 is one in the embodiment of FIG. 2, but is not limited thereto; and for example, a plurality of temperature elements 61 including at least one metal well 71 may be prepared, and the plurality of temperature elements 61 may be connected for use.

The DNA amplification device 51 has been described above for the case of including the single temperature element 61 with reference to FIG. 2; however, the number of the temperature element 61 included in the DNA amplification device 51 is not limited to the above example in particular.

For example, M units of temperature elements 61 can be serially-connected into a linear shape.

In this case, temperature control (temperature control for coarse adjustment) of the entirety of the M units of temperature elements 61 can be implemented by employing main temperature control in which an electric current is applied in the serially-connected direction.

On the other hand, individual temperature control (temperature control for fine adjustment) of each of the M units of temperature elements 61 can be implemented independently and parallelly with the main control by employing sub temperature control, in which an electric current is independently applied to each one of the M units of temperature elements 61 in a direction substantially perpendicular to the serially-connected direction.

The sub temperature control of the reference element is omissible if a predetermined one of the M units of temperature elements 61 is used as a reference element.

The unit for the sub temperature control does not have to be a single temperature element 61, and may be two or more temperature elements 61 as well.

In this manner, by serially connecting the M units of temperature elements 61 to appropriately combine the main temperature control and the sub temperature control, the influence due to unevenness among the M units of temperature elements can be neutralized, and the variation in temperature of each of the plurality of temperature elements can be made substantially identical.

Conversely, individual temperature control is also easily possible by setting different temperature target values to each of the plurality of temperature elements 61, by appropriately combining the main temperature control and the sub temperature control.

Furthermore, there may be N serial connections for the M units of the temperature elements 61.

In this case, the temperature control unit 62 can execute the main temperature control and the sub temperature control for each of the N serial connections independently.

In other words, the temperature elements 61 can be arranged in a matrix of N lines and M columns. In this case, directions of applying electric currents can be divided into a line direction and a column direction. In this case, for example, the temperature control unit 62 can execute the main temperature control for controlling the electric current flowing in the line direction, and can execute the sub temperature control for controlling the electric current flowing in the column direction. In this way, individual temperature control can be executed in the line direction and the column direction in a mutually independent manner.

In this case as well, by combining the main temperature control and the sub temperature control as appropriate, the influence due to unevenness among the M units of temperature elements can be neutralized, and the variation in temperature of each of the plurality of temperature elements can be made substantially identical.

Conversely, by combining the main temperature control and the sub temperature control as appropriate, it is also possible to easily execute individual temperature control by setting different temperature target values to the plurality of temperature elements 61, respectively.

The objects arranged in the matrix of N lines and M columns, on which the main temperature control and the sub temperature control are executed, do not have to be the temperature elements 61 in particular; and arbitrary temperature elements capable of achieving the Peltier effect can be employed.

Figure 6:
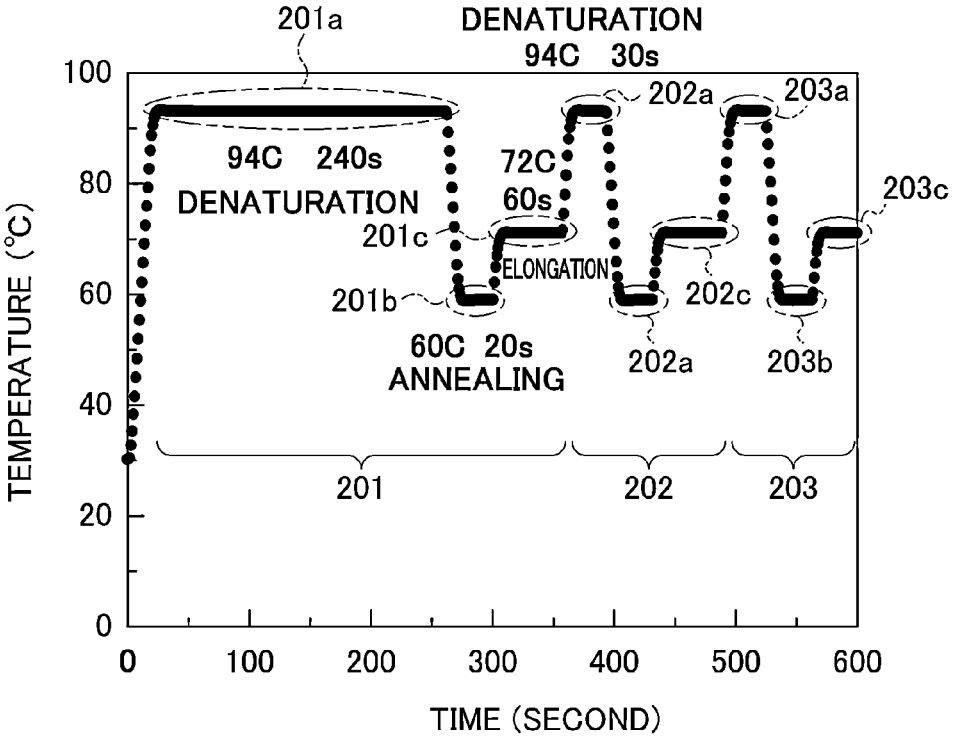
FIG. 6 is a graph showing a time series variation of temperature of a DNA sample (reaction solution) in a case in which a PCR test is carried out by using the DNA amplification device including the temperature element having a thin metal well according to the present invention.
Figure 7:
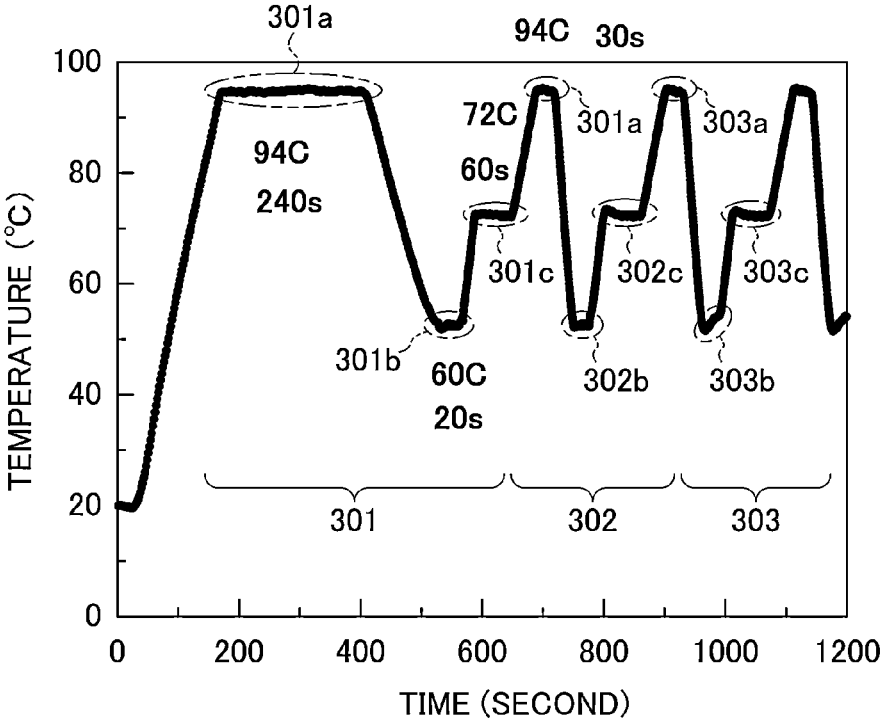
FIG. 7 is a graph showing a time series variation of temperature of a DNA sample (reaction solution) in a case in which a PCR test is carried out by using a DNA amplification device including a temperature element having a conventional thick metal well.
Figure 8:
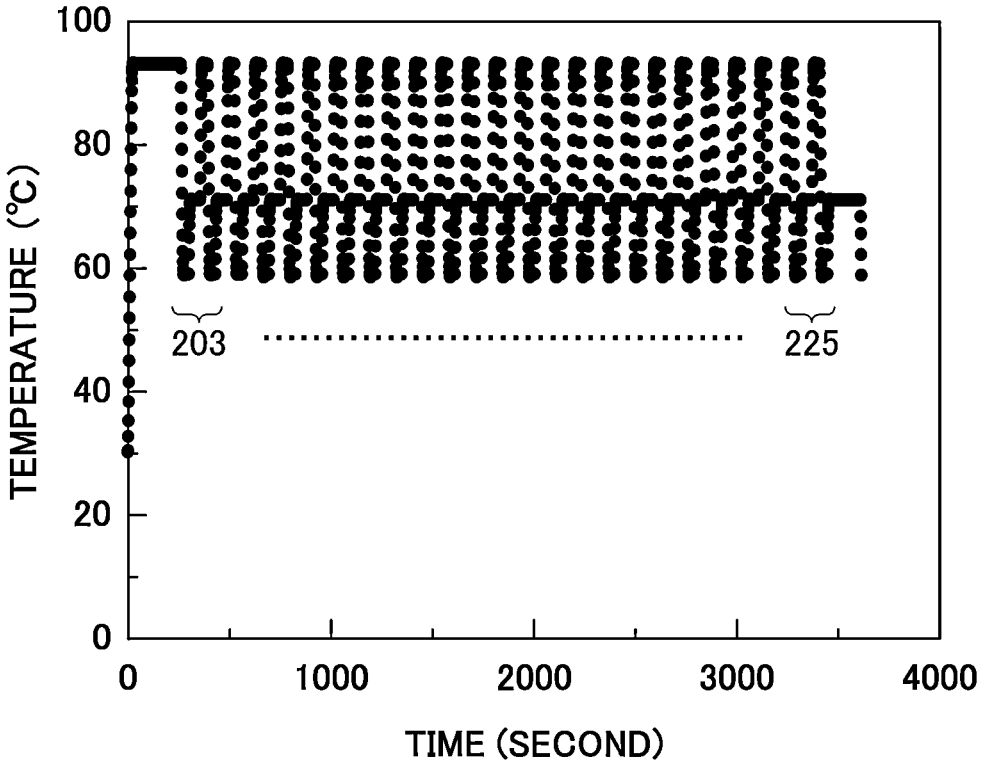
FIG. 8 is a graph showing a time series variation of temperature of a DNA sample (reaction solution) in a case in which 25 cycles of PCR tests are carried out by using the DNA amplification device including the temperature element having the thin metal well according to the present invention.

The temperature elements 61 achieving the various effects as described above are applied to PCR, i.e. the plastic tube 91 used for containing a DNA sample is employed as an object, thereby making it possible to change the temperature of the DNA sample to follow a predetermined pattern of temporal transition of a temperature target value in PCR. That is to say, as shown in FIGS. 6 to 8, highly responsive temperature control of a DNA sample can be realized in PCR. As a result, the duration required for a single step is reduced, the treatment efficiency can be improved, and the power saving characteristics can be improved.

FIGS. 6 to 8 are graphs showing comparison of PCR tests under the controlled condition, between a case of using the conventional DNA amplification device including the conventional Peltier element 1, and a case of using the DNA amplification device 51 including the temperature element 61 according to the present invention.

FIG. 6 is a graph showing a time series variation of temperature of a DNA sample (reaction solution) in a case in which a PCR test is carried out by using the DNA amplification device 51 including the temperature element 61 having the thin metal well 71 according to the present invention.

FIG. 7 is a graph showing a time series variation of temperature of a DNA sample (reaction solution) in a case in which a PCR test is carried out by using the conventional DNA amplification device.

FIG. 8 is a graph showing a time series variation of temperature of a DNA sample (reaction solution) in a case in which 25 cycles of PCR tests are carried out by using the DNA amplification device 51 including the temperature element 61 having the thin metal well 71 according to the present invention. In FIGS. 6 to 8, the vertical axis represents temperature (° C.), and the horizontal axis represents time (second).

Patterns of the temporal transition of the temperature target value in the PCR tests are described as follows in (A) to (C).

(A) First of all, the temperature target value was set at 94° C., and the temperature was raised to 94° C. and maintained at 94° C. for 240 seconds (denaturation). This period corresponds to a period 201*a* in FIG. 6, and corresponds to a period 301*a* in FIG. 7.

(B) Subsequently, the temperature target value was switched to 60° C., and the temperature was lowered to 60° C. and maintained at 60° C. for 20 seconds (annealing). This period corresponds to a period 201*b* in FIG. 6, and corresponds to a period 301*b* in FIG. 7.

(C) Subsequently, the temperature target value was switched to 72° C., and the temperature was raised to 72° C. and maintained at 72° C. for 60 seconds (elongation). This period corresponds to a period 201*c* in FIG. 6, and corresponds to a period 301*c* in FIG. 7. Subsequently, the period in step (A) (denaturation) was switched to 30 seconds, and 25 cycles were carried out for the periods 201 to 301 (denaturation to elongation).

Test conditions are described as follows in (a) to (c).

a) A standardized plastic tube 91 of 0.2 ml was used for both the tests, in which a bore diameter of the mounting portion of the plastic tube 91 was 9.6 mm. However, the conventional metal well having the mounting portion was employed, in which the metal well was thicker than the metal well 71 having the mounting portion 81 according to the present invention.

(b) In both of the tests, the temperature of the DNA sample (reaction solution) was measured by inserting an identical thermocouple into the plastic tube 91.

(c) In the PCR test using the DNA amplification device 51 including the temperature element 61 according to the present invention, output currents of the temperature control unit 62 were as follows.

That is to say, during the period 201*a* of FIG. 6, the output current was 19.6 A in the heating period (the period of raising the temperature to 94° C.), and the output current was 10.4 A in the temperature retention period (the period of maintaining the temperature at 94° C.). During the period 201*b* of FIG. 6, the output current was 18.1 A in the cooling period (the period of lowering the temperature to 60° C.), and the output current was 5.4 A in the temperature retention period (the period of maintaining the temperature at 60° C.). During the period 201*c* of FIG. 6, the output current was 18.5 A in the heating period (the period of raising the temperature to 72° C.), and the output current was 7.3 A in the temperature retention period (the period of maintaining the temperature at 72° C.)

In the case in which the PCR test was carried out by using the conventional DNA amplification device including the conventional metal well, as is apparent from the waveforms blurring in all of the periods 301*a* to 301*c* of FIG. 7, the temperature of the DNA sample (reaction solution) did not change to follow the pattern of the temporal transition of the temperature target value. That is to say, delay occurred until the temperature of the DNA sample (reaction solution) reached the temperature target value (94° C. in the period 301*a;* 60° C. in the period 301*b*; and 72° C. in the period 301*c*). As is apparent from comparison of the elongation period 301*c* in the first cycle 301 with the elongation period 303*c* in the third cycle, the waveform is disturbed as the cycle number is increased, which means that nonspecific sequences (products that are not intended) are also amplified together. In contrast, in the case in which the PCR test was carried out by using the DNA amplification device 51 including the temperature element 61 having the metal well 71 according to the present invention, as shown in FIG. 8, almost no disturbance is observed between the waveform in the first cycle 205 and the waveform in the last cycle 225.

In this manner, with the conventional DNA amplification device, the temperature of the DNA sample (reaction solution) cannot follow the pattern of the temporal transition of the temperature target value. The reason for this is as follows. That is to say, as described above, this is because the temperature variation in the side-A region of the conventional Peltier element 1 is transferred to the plastic tube 91 mounted to the metal well via the metal well serving as the delay element.

In contrast, in the case in which the PCR test was carried out by using the DNA amplification device 51 including the temperature element 61 having the metal well 71 according to the present invention, as is apparent from the sharp waveforms throughout the periods 201*a* to 201*c* in FIG. 6, the temperature of the DNA sample (reaction solution) changes so as to substantially follow the pattern of the temporal transition of the temperature target value. That is to say, delay does not substantially occur until the temperature of the DNA sample (reaction solution) reaches the temperature target value (94° C. in the period 201*a;* 60° C. in the period 201*b*; and 72° C. in the period 201*c*). As a result, with regard to the target of "maintaining the temperature at 94° C. for 240 seconds" for the pattern (A) of the temporal transition of the temperature target value, the temperature was within 94° C.±0.5° C. for 240 seconds in the period 201*a* in FIG. 6; therefore, the target was achieved. Similarly, with regard to the target of "maintaining the temperature at 60° C. for 20 seconds" for the pattern (B) of the temporal transition of the temperature target value, the temperature was within 60° C.±0.5° C. for 20 seconds in the period 201*c* in FIG. 6; therefore, the target was achieved. With regard to the target of "maintaining the temperature at 72° C. for 60 seconds" for the pattern (C) of the temporal transition of the temperature target value, the temperature was within 72° C.±0.5° C. for 60 seconds in the period 201*c* in FIG. 6; therefore, the target was achieved.

Furthermore, it should be noted that not only the target of ±0.5° C. was achieved, but also further higher precision of ±0.01° C. was achieved.

The reason why the plotted points in FIG. 6 are spaced apart when raising or lowering the temperature is that the temperature gradient is steep, namely, the responsiveness of the temperature control was improved to allow the temperature to be raised or lowered in a short time.

In this manner, with the DNA amplification device 51 including the temperature element 61 having the metal well 71 according to the present invention, the temperature of the DNA sample (reaction solution) can follow the pattern of the temporal transition of the temperature target value. The reason for this is as follows. That is to say, as described above, since the extremely thin metal well 71 does not remove extra heat, the heat is directly transferred to the plastic tube 91 without intervention of any delay elements.

Figure 9A:
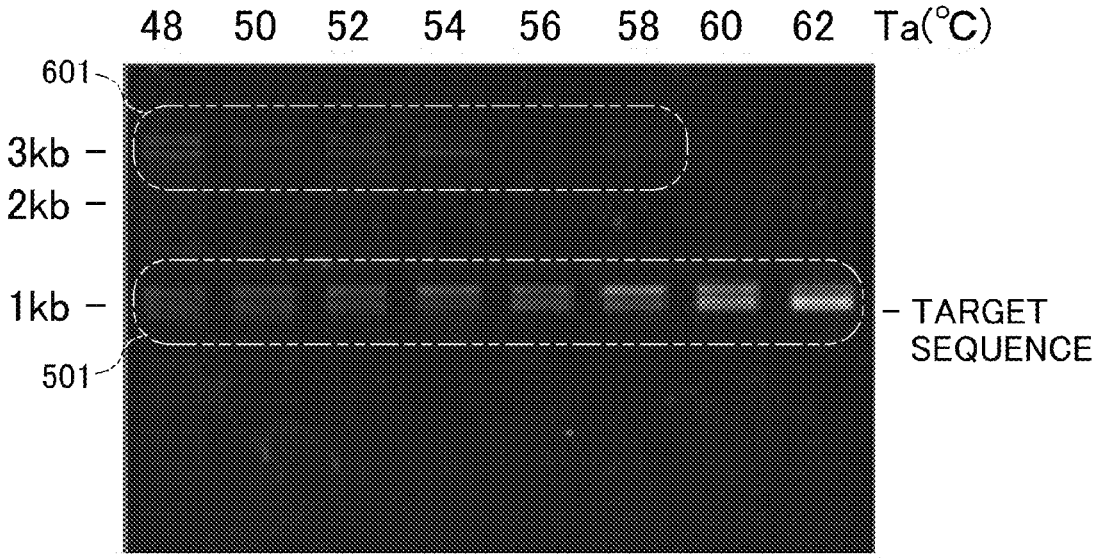
FIGS. 9A and 9B are a diagram showing comparison of PCR tests under the controlled condition, between a case of using the conventional DNA amplification device including the temperature element having the conventional metal well, and a case of using the DNA amplification device including the temperature element having the metal well according to the present invention.
Figure 9B:
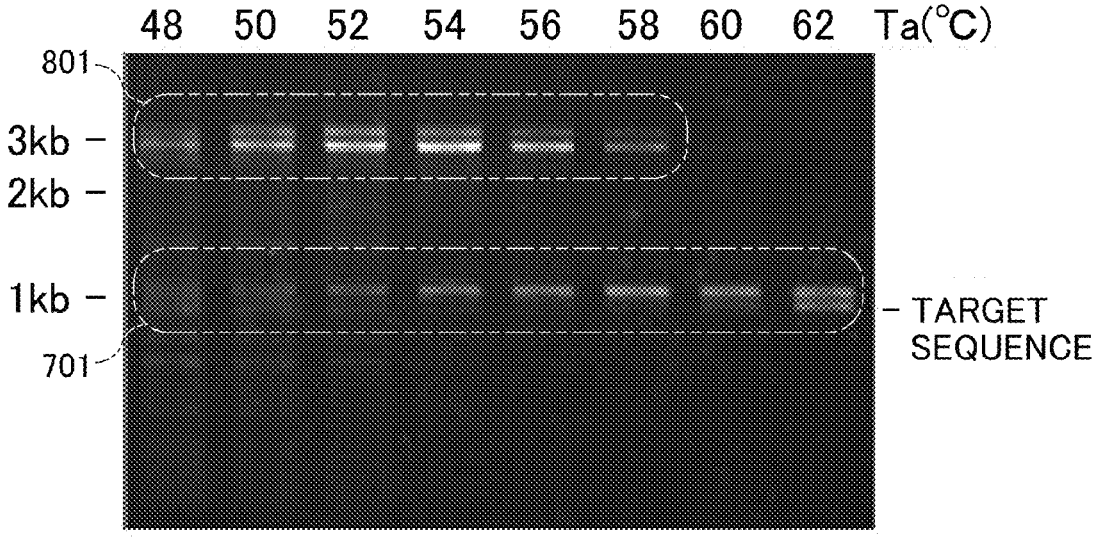

FIGS. 9A and 9B are a diagram showing comparison of PCR tests under the controlled condition, between a case of using the conventional DNA amplification device, and a case of using the DNA amplification device 51 including the temperature element 61 having the metal well 71 according to the present invention.

FIG. 9A is a diagram showing an agarose gel electrophoresis photograph, in a case in which a PCR test is carried out by using the DNA amplification device 51 including the temperature element 61 having the thin metal well 71 according to the present invention.

FIG. 9B is a diagram showing an agarose gel electrophoresis photograph, in a case in which a PCR test is carried out by using the conventional DNA amplification device. In FIGS. 9A and 9B, the horizontal axis represents temperature (° C.), and the horizontal axis represents length (kb) of a DNA fragment.

Materials and method for the agarose gel electrophoresis photographs in the two PCR tests are as follows.

PCR was carried out by targeting an internal region of an AT1G15830 gene of *Arabidopsis*. Target sequence length is 1,000 bp (1 kb). Genomic DNA (gDNA) of *Arabidopsis* was used as template DNA.

A reaction liquid composition was: 0.5 ng/μl: gDNA, 0.2 μM: primer, 0.2 mM: dNTP, 2.0 mM: MgCl2, 1× ExTaq buffer, 0.025 U/μl ExTaq DNA polymerase.

As thermal cycle conditions, three steps were repeated 25 times, including: thermal denaturation at 94° C. for 4 minutes at first; thermal denaturation at 94° C. for 30 seconds per cycle; Ta (annealing) for 20 seconds; and elongation at 72° C. for 60 seconds; followed by additional elongation at 72° C. for 3 minutes. Ta was carried out between 48° C. and 62° C. at 2° C. intervals, and speed of changing the temperature was 3° C./second in both of raising and lowering the temperature.

iCycler (manufactured by Bio-Rad Laboratories, Inc.) was used for the control experiment, and the same temperature conditions as described above were used.

Result

By subjecting the reagent to agarose gel electrophoresis, an amplification result shown in the agarose gel migration photograph of FIGS. 9A and 9B were obtained. As shown in FIG. 9B, in the control experiment (the experiment using the conventional DNA amplification device), a target sequence (a pair of upper and lower bars) 701 hardly increased at 58° C. or lower, and a large number of nonspecific sequences (unintended product) 801 were observed. Amplification of the target sequence 701 as an intended product was finally observed at 60° C. or higher.

In contrast, as shown in FIG. 9A, in the case in which the PCR test was carried out by using the metal well 71 according to the present invention, a target sequence 501 as an intended product was observed at temperature of at least 50° C. or higher; therefore, it is considered that the intended product was amplified at temperature of at least 50° C. or higher. As is apparent from the result that nonspecific sequences almost did not appear, the nonspecific sequences were dramatically decreased, and remarkable improvement was recognized.

Therefore, as is clear from the above result, a target sequence is difficult to appear as a pair in the case of using the conventional metal well.

In the case of using the conventional metal, the nonspecific sequences were also amplified above and below the target sequence.

The result reflects that the temperature gradient is larger and the temperature is more accurately followed in the case of using the DNA amplification device 51 having the metal well 71 according to the present invention, than in the case of using the conventional DNA amplification device.

The present invention can achieve effects as follows for example, without depending on the various embodiments. The temperature control device according to the present invention is implemented by a configuration disclosed as follows.

The metal well 71 provided to the temperature element 61 according to the present invention, in which the p-type semiconductor 72P is directly joined to the N-type semiconductor 72*n*, has a function of producing the Peltier effect by applying an electric current and transferring heat from one to the other of the p-type semiconductor 72P and the n-type semiconductor 72N. The metal well 71 includes the mounting portion 81 capable of directly mounting an object to be cooled or heated. Therefore, the object is heated or cooled in an intimate manner by the p-type semiconductor 72P and the n-type semiconductor 72*n* without intervention of a delay element (for example, extra thickness of the metal well 71) for the temperature control system. That is to say, the p-type semiconductor 72P and the n-type semiconductor 72*n* can directly transfer the heat of the p-type semiconductor 72P and the n-type semiconductor 72*n* to the object mounted to the metal well 71. Therefore, the heat transferred through the path is directly supplied to the object, thereby heating the object; and the heat emitted from the object is directly supplied to the path, thereby cooling the object. As a result, highly responsive temperature control is realized, as compared to the case of employing the Peltier element 1 having the conventional metal well 71.

The DNA amplification device 51 according to the first embodiment of the present invention has been described above.

Next, a DNA amplification device 151 according to a second embodiment of the present invention is described.

Second Embodiment

The DNA amplification device 151 according to the second embodiment of the present invention can have a schematic configuration, which is basically similar to the DNA amplification device 51 according to the first embodiment.

Therefore, FIG. 2 is also a top plan view showing the schematic configuration of the DNA amplification device 151 according to the second embodiment of the present invention. However, the shape of the metal well 71 in the second embodiment differs from that in the first embodiment. In the second embodiment, in addition to the metal well 71 with a different shape, a placing portion 111 is employed in place of the mounting portion 81 of the first embodiment.

Figure 10:
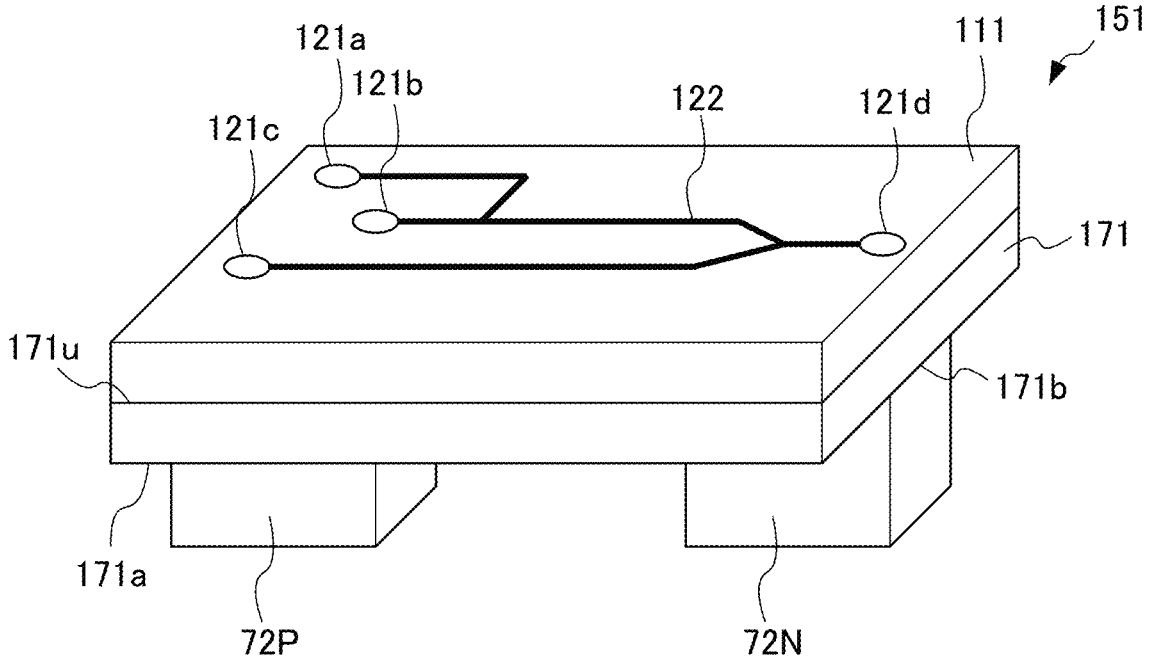
FIG. 10 is a perspective view showing a schematic configuration of a DNA amplification device according to a second embodiment.

FIG. 10 is a perspective view showing a schematic configuration of the DNA amplification device 151 according to the second embodiment.

The DNA amplification device 151 includes a temperature element 61, a temperature control unit 62, and a water-cooling unit 63. Among the configurations of the DNA amplification device 151, the configurations of the temperature control unit 62 and the water-cooling unit 63 are basically similar to those in the first embodiment; therefore, descriptions thereof are omitted.

The temperature element 61 includes a metal well 171, a set of p-type semiconductor 72P and n-type semiconductor 72N, electrode-radiator plates 73P and 73N, and water pipes 74P and 74N. Among the configurations of the temperature element 61, the configurations of the set of p-type semiconductor 72P and n-type semiconductor 72N, the electrode-radiator plates 73P and 73N, and the water pipes 74P and 74N are basically similar to the configurations in the first embodiment; therefore, descriptions thereof are omitted.

The metal well 171 is formed into a flat plate of, for example, 1 cm in vertical size and 1 cm in horizontal size. The other end of the p-type semiconductor 72P is directly joined to one end 171*a* of the metal well 171; whereas the other end of the n-type semiconductor 72N is directly joined to the other end 171*b*, which is opposed to the one end 171*a* of the metal well 171.

The metal well 171 of the present embodiment has a function of directly joining the set of the p-type semiconductor 72P and the n-type semiconductor 72N, namely, the function similar to the electrode plate 22A of the conventional Peltier element 1 of FIG. 1. That is to say, the function produces the Peltier effect by applying an electric current and transferring heat from one to the other of the p-type semiconductor 72P and the n-type semiconductor 72N.

A top surface 171*u* of the metal well 171 includes the placing portion 111 for directly placing an object to be heated or cooled.

A point notable herein is that an external shape of the metal well 171 is substantially similar to an external shape of the placing portion 111. That is to say, the metal well 171 is thinly formed so as to reduce the distance between the placing portion 111 (more precisely, the DNA sample) and the p-type semiconductor 72P and the n-type semiconductor 72.

The placing portion 111 is also typically referred to as a capillary chip, and is formed into a flat plate of, for example, 1 cm in vertical size and 1 cm in horizontal size, in conformity with the metal well 171. The placing portion 111 includes a plurality of inlets 121*a*, 121*b*, 121*c*, 121*d*, and a capillary 122 for placing an object that is a liquid such as a DNA sample in PCR. The inlets 121*a*, 121*b*, 121*c* and 121*d* are collectively referred to as "inlet 121" when the inlets are not required to be distinguished in particular.

Each inlet 121 is formed into a hole such that a liquid such as a DNA sample can be injected thereinto with a pipette or micropipette. The plurality of inlets 121 are formed in the placing portion 111, and the number thereof is not limited in particular; however, the four inlets 121 are formed in the present embodiment.

The capillary 122 is configured by a plurality of passages (capillaries) that connect the inlets 121*a*, 121*b*, 121*c* and 121*d* one another. In a single passage, the liquid (object) injected from one inlet 121 travels to another inlet 121 by way of a capillary phenomenon. More specifically, for example, the liquid injected from the inlet 121*a* travels through the capillary 122 by way of a capillary phenomenon, and travels to the other inlet 121*b*, 121*c* or 121. As a result, in the capillary 122, the liquid injected from an inlet (for example, the inlet 121*a*) can be blended with a liquid injected from another inlet (for example, the inlet 121*b*, 121*c* or 121*d*).

The metal well 171 provided to the temperature element 61 according to the present invention, in which the p-type semiconductor 72P is directly joined to the N-type semiconductor 72*n*, has a function of producing the Peltier effect by applying an electric current and transferring heat from one to the other of the p-type semiconductor 72P and the n-type semiconductor 72N. The metal well 171 includes the placing portion 111 capable of directly mounting an object to be cooled or heated. Therefore, the object is heated or cooled in an intimate manner by the p-type semiconductor 72P and the n-type semiconductor 72*n* without intervention of a delay element (for example, extra thickness of the metal well 171) for the temperature control system. That is to say, the p-type semiconductor 72P and the n-type semiconductor 72*n* can directly transfer the heat of the p-type semiconductor 72P and the n-type semiconductor 72*n* to the object placed on the metal well 171. Therefore, the heat transferring through the path is directly supplied to the object, thereby heating the object; and the heat emitted from the object is directly supplied to the path, thereby cooling the object. As a result, highly responsive temperature control is realized, as compared to the case of employing the Peltier element 1 having the conventional metal well 71.

The DNA amplification device 151 according to the second embodiment of the present invention has been described above.

Next, a DNA amplification device 251 according to a third embodiment of the present invention is described.

Third Embodiment

The DNA amplification device 251 according to the third embodiment of the present invention can have a schematic configuration, which is basically similar to the DNA amplification device 51 according to the first embodiment.

Therefore, FIG. 2 is also a top plan view showing the schematic configuration of the DNA amplification device 251 according to the third embodiment of the present invention. However, the shape of the metal well 71 in the third embodiment differs from that in the first embodiment. In addition to the metal well 71 with a different shape, a placing portion 211 is employed in place of the mounting portion 81 of the first embodiment.

Figure 11:
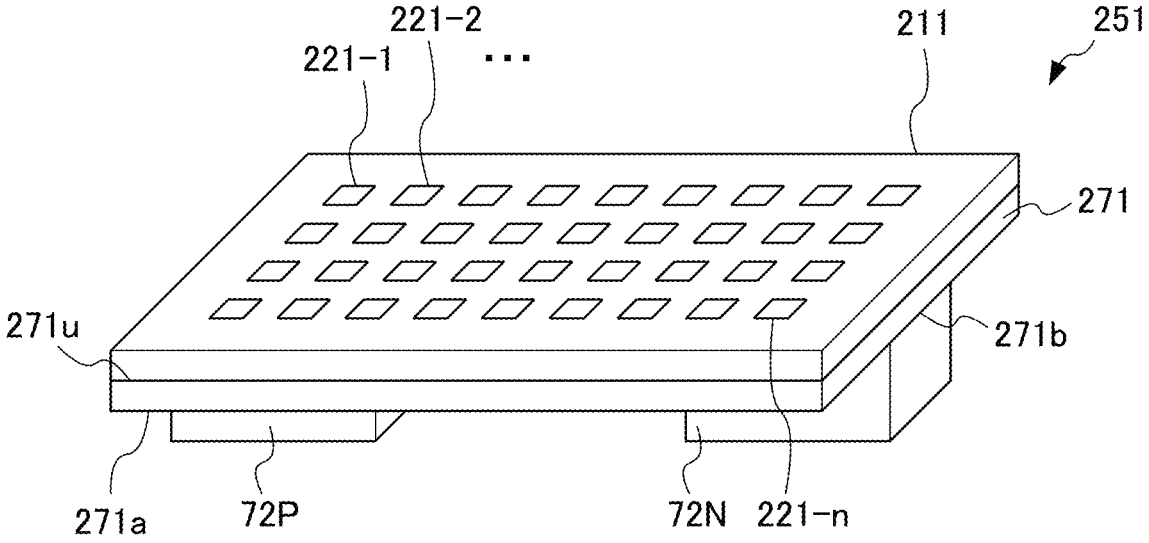
FIG. 11 is a perspective view showing a schematic configuration of a DNA amplification device according to a third embodiment.

FIG. 11 is a perspective view showing a schematic configuration of the DNA amplification device 251 according to the third embodiment.

The DNA amplification device 251 includes a temperature element 61, a temperature control unit 62, and a water-cooling unit 63. Among the configurations of the DNA amplification device 251, the configurations of the temperature control unit 62 and the water-cooling unit 63 are basically similar to those in the first embodiment; therefore, descriptions thereof are omitted.

The temperature element 61 includes a metal well 271, a set of p-type semiconductor 72P and n-type semiconductor 72N, electrode-radiator plates 73P and 73N, and water pipes 74P and 74N. Among the configurations of the temperature element 61, the configurations of the set of p-type semiconductor 72P and n-type semiconductor 72N, the electrode-radiator plates 73P and 73N, and the water pipes 74P and 74N are basically similar to the configurations in the first embodiment; therefore, descriptions thereof are omitted.

The metal well 271 is formed into a flat plate of, for example, 1 cm in vertical size and 1 cm in horizontal size. The other end of the p-type semiconductor 72P is directly joined to one end 271*a* of the metal well 271; whereas the other end of the n-type semiconductor 72N is directly joined to the other end 271*b*, which is opposed to the one end 271*a* of the metal well 271.

The metal well 271 of the present embodiment has a function of directly joining the set of the p-type semiconductor 72P and the n-type semiconductor 72N, namely, the function similar to the electrode plate 22A of the conventional Peltier element 1 of FIG. 1. That is to say, the function is a function of producing the Peltier effect by applying an electric current and transferring heat from one to the other of the p-type semiconductor 72P and the n-type semiconductor 72N.

A top surface 271*u* of the metal well 271 includes a placing portion 211 for directly placing an object to be heated or cooled.

A point notable herein is that an external shape of the metal well 271 is substantially similar to an external shape of the placing portion 211. That is to say, the metal well 271 is thinly formed so as to reduce the distance between the placing portion 211 (more precisely, a DNA sample) and the p-type semiconductor 72P and the n-type semiconductor 72N.

The placing portion 211 is formed into a flat plate of, for example, 1 cm in vertical size and 1 cm in horizontal size, in conformity with the metal well 171. The placing portion 211 includes a plurality of concave portions 221-1, 221-2, . . . and 221-*n* (n is a natural number of at least 1) for placing an object that is a liquid such as a DNA sample in PCR. The concave portions 221-1, 221-2, . . . and 221-*n* are collectively referred to as "concave portion 221" when the concave portions are not required to be distinguished in particular.

Each concave portion 221 is formed into a rectangular dent with one side of, for example, several 10 μm, and is formed to be capable of receiving a liquid dropped by a pipette or micropipette. The plurality of concave portions 221 are formed on the placing portion 211, and the number thereof is not limited in particular; however, in the present embodiment, the 36 concave portions 221 are formed in total, which are arranged at a substantially equal interval in a matrix of 9 lines in a horizontal direction and 4 lines in a vertical direction of the placing portion 211.

The metal well 271 provided to the temperature element 61 according to the present invention, in which the p-type semiconductor 72P is directly joined to the N-type semiconductor 72*n*, has a function of producing the Peltier effect by applying an electric current and transferring heat from one to the other of the p-type semiconductor 72P and the n-type semiconductor 72N. The metal well 271 includes the placing portion 211 capable of directly mounting an object to be cooled or heated. Therefore, the object is heated or cooled in an intimate manner by the p-type semiconductor 72P and the n-type semiconductor 72*n* without intervention of a delay element (for example, extra thickness of the metal well 271) for the temperature control system. That is to say, the p-type semiconductor 72P and the n-type semiconductor 72*n* can directly transfer the heat of the p-type semiconductor 72P and the n-type semiconductor 72*n* to the object placed on the metal well 271. Therefore, the heat transferring through the path is directly supplied to the object, thereby heating the object; and the heat emitted from the object is directly supplied to the path, thereby cooling the object. As a result, highly responsive temperature control is realized, as compared to the case of employing the Peltier element 1 having the conventional metal well 71.

The present invention is not limited to the present embodiment, and modification, improvement and the like within a scope that can achieve the object of the invention are included in the present invention.

For example, the present embodiment has been described for an example of applying the present invention to the DNA amplification device 51, in which the temperature element 61 follows change in temperature of a DNA sample (reaction solution) in relation to a predetermined temperature pattern in PCR; however, the present invention is not limited thereto. For example, the present invention can be applied to a control device in general, in which the temperature element 61 follows change in temperature of a liquid other than a DNA sample (reaction solution), in relation to a predetermined temperature pattern in a method of controlling temperature of a typical liquid.

The invention claimed is:

1. A temperature control device for heating or cooling an object, the device comprising:

a temperature element configured to heat or cool the object by way of a Peltier effect; and a control unit configured to execute energization control of the temperature element, wherein the temperature element comprises:

a set of p-type semiconductor and n-type semiconductor arranged to be separated from each other;

a joining region comprising a mounting portion configured to mount the object, join with the p-type semiconductor on a first surface, and join with the n-type semiconductor on a second surface opposed to the first surface;

a first electrode region joined to the p-type semiconductor, to which the control unit applies voltage; and a second electrode region joined to the n-type semiconductor, to which the control unit applies voltage, wherein the joining region is formed into a shape substantially identical to an external shape of the object, and wherein the control unit applies different voltage to the first electrode region and the second electrode region to produce potential difference between the p-type semiconductor and the n-type semiconductor, the joining region is configured to produce the Peltier effect by applying an electric current and transferring heat from one to the other of the p-type semiconductor and the n-type semiconductor.

2. The temperature control device according to claim 1, wherein the object is a predetermined container used for containing DNA (deoxyribonucleic acid), and wherein the mounting portion is processed for mounting the container.

3. The temperature control device according to claim 1, wherein the cooling unit is configured to cool at least one of the first electrode region and the second electrode region of the temperature element.

4. The temperature control device according to claim 1, wherein the temperature control device is a portable device.

5. The temperature control device according to claim 1, wherein a surface of the p-type semiconductor contacts the first surface of the mounting portion; and a surface of the n-type semiconductor contacts the second surface of the mounting portion.

6. The temperature control device according to claim 1, wherein a surface of the p-type semiconductor contacts the first region of the mounting portion; and a surface of the n-type semiconductor contacts the second region of the mounting portion.

7. A temperature element for heating or cooling an object by way of a Peltier effect, the element comprising:

a set of p-type semiconductor and n-type semiconductor arranged to be separated from each other;

a joining region comprising a mounting portion for mounting the object, and join each of the p-type semiconductor and the n-type semiconductor;

a first electrode region joined to the p-type semiconductor, to which voltage is externally applied; and a second electrode region joined to the n-type semiconductor, to which voltage is externally applied, wherein the joining region is formed into a shape substantially identical to an external shape of the object, and wherein, in a case in which different voltage is externally applied to the first electrode region and the second electrode region to produce potential difference between the p-type semiconductor and the n-type semiconductor, the joining region is configured to produce the Peltier effect by applying an electric current and transferring heat from one to the other of the p-type semiconductor and the n-type semiconductor.

8. The temperature element according to claim 7, wherein the mounting portion is processed in conformity to a shape of the object, and is formed in the joining region.

9. The temperature element according to claim 8, wherein the joining region is formed substantially uniformly in thickness dimension, and is formed along a shape of the mounting portion.

10. The temperature control device according to claim 7, wherein a surface of the p-type semiconductor contacts a first surface of the mounting portion; and a surface of the n-type semiconductor contacts a second surface of the joining region opposed to the first surface of the mounting portion.

11. A temperature control device for heating or cooling an object, the device comprising:

a temperature element configured to heat or cool the object by way of a Peltier effect; and a control unit configured to execute energization control of the temperature element, wherein the temperature element comprises:

a set of p-type semiconductor and n-type semiconductor arranged to be separated from each other;

a joining region comprising a placing portion configured to place the object, join with the p-type semiconductor on a first region, and join with the n-type semiconductor on a second region opposed to the first region;

a first electrode region joined to the p-type semiconductor, to which the control unit applies voltage; and a second electrode region joined to the n-type semiconductor, to which the control unit applies voltage, wherein the joining region is formed into a shape substantially identical to an external shape of the placing portion, and wherein the control unit applies different voltage to the first electrode region and the second electrode region to produce potential difference between the p-type semiconductor and the n-type semiconductor, the joining region is configured to produce the Peltier effect by applying an electric current and transferring heat from one to the other of the p-type semiconductor and the n-type semiconductor.

12. The temperature control device according to claim 11, wherein the placing portion comprises:

an inlet, into which the object is injected; and a capillary configured to cause the object injected from the inlet to travel by way of a capillary phenomenon.

13. The temperature control device according to claim 11, wherein the placing portion comprises a plurality of concave portions for receiving the object.

* * * * *